US005931043A

United States Patent [19]

Liegel et al.

[11] Patent Number: 5,931,043

[45] Date of Patent: Aug. 3, 1999

[54] MULTI-MODULAR VEHICLE REPAIR SYSTEM

[75] Inventors: Reinald D. Liegel, Waukesha; Jeffrey V. Russell, Oconomowoc; James G. Ballard, Waukesha, all of Wis.

[73] Assignee: Hein-Werner Corporation, Wis.

[21] Appl. No.: 08/984,495

[22] Filed: Dec. 3, 1997

[51] Int. Cl.[6] ..... B21D 1/12

[52] U.S. Cl. ..... 72/457; 72/705

[58] Field of Search ..... 72/457, 705

[56] References Cited

U.S. PATENT DOCUMENTS

| | | | |
|---|---|---|---|
| 3,754,427 | 8/1973 | Hunnicutt et al. | 72/302 |
| 3,869,767 | 3/1975 | Hunnicutt et al. | 24/243 |
| 4,313,335 | 2/1982 | Eck | 72/457 |
| 4,694,674 | 9/1987 | Lawrence | 72/705 |
| 4,745,791 | 5/1988 | Fish | 72/705 |
| 4,794,783 | 1/1989 | Eck | 72/447 |
| 4,905,496 | 3/1990 | Venalainen | 72/705 |
| 4,986,107 | 1/1991 | Peyret | 72/705 |

*Primary Examiner*—Lowell A. Larson
*Attorney, Agent, or Firm*—Foley & Lardner

[57] ABSTRACT

The present invention provides a single system to accommodate the various types of vehicle repair situations. The present invention provides a multi-modular vehicle repair system comprising a vehicle repair frame, a vehicle restraint removably mounted on the vehicle repair frame and a force device associated with the vehicle repair frame. Additionally, the present invention provides vehicle repair modules that can be attached to or associated with the vehicle repair frame. Such vehicle repair modules includes a frame support module, a lift module and a ramp module. Each of those modules can be of different types to accommodate the varying conditions of vehicle repair encountered by the vehicle repair facility operator.

4 Claims, 9 Drawing Sheets

66
36
32
62
81
84
86
87
88
89
64
82
83
80
90
60
31
85

MULTI-MODULAR VEHICLE REPAIR SYSTEM

FIELD OF THE INVENTION

The present invention relates to the vehicle repair field and particularly to a system for moving, positioning and manipulating a vehicle and vehicle parts in a vehicle repair facility primarily when the vehicle is damaged or in need of repairs.

BACKGROUND OF THE INVENTION

In the vehicle repair business, a damaged or in-need-of-repair vehicle is usually brought to a vehicle body shop or the like for corrective measures. Vehicle bodies and frames come in different shapes and sizes, from the smallest foreign made vehicles to pick-up trucks. To repair such vehicles, the vehicle repair facility must have available a repair system, usually called a "rack" or a "frame pulling" bench. Such situation can be expensive and can take up precious space in a vehicle repair facility. Many different types of repair systems are available from the in-ground type such as described in this Applicant's assignee's predecessor's U.S. Pat. Nos.: 3,754,427 and 3,869,767, the walk-through type described in this Applicant's assignees' predecessor's U.S. Pat. No. 4,794,783, the 360° oval type rack described in this Applicant's assignee's predecessor's U.S. Pat. No. 4,313,335 and variants of such system manufactured by this Applicant's assignee or others.

The principal problem with such range of devices is that none can be economically or ergonomically efficient for various types of vehicle repair jobs. The above cited patents describe, respectively, repair racks and systems that lay on a surface or set in a surface such as described in U.S. Pat. No. 3,754,427 and U.S. Pat. No. 3,869,767, or a rack that the operator can walk under the vehicle being supported by the rack system such as in U.S. Pat. No. 4,794,783 or a rack that provides for applying a force to a vehicle mounted on such rack from any point around (360°) the vehicle, such as described in U.S. Pat. No. 4,313,335. An operator of a vehicle repair facility would have to have all three types of repair systems and their associated parts to accommodate all types of vehicle repairs. Such a situation is not economically feasible nor usually possible because of space restraints in the repair facility.

The present invention provides a single system to accommodate the various types of vehicle repair situations. The present invention provides a multi-modular vehicle repair system comprising a vehicle repair frame, a vehicle restraint removably mounted on the vehicle repair frame and a force device associated with the vehicle repair frame. Additionally, the present invention provides vehicle repair modules that can be attached to or associated with the vehicle repair frame. Such vehicle repair modules includes a frame support module, a lift module and a ramp module. Each of those modules can be of different types to accommodate the varying conditions of vehicle repair encountered by the vehicle repair facility operator.

SUMMARY OF THE INVENTION

The present invention provides a unique multi-modular vehicle repair system for moving, positioning and manipulating a vehicle and vehicle parts when a vehicle is damaged or in need of repairs. The multi-modular vehicle repair system includes various separate modules, tools and apparatus that can be used individually or in association with each other to facilitate the various operations encountered in a vehicle repair facility.

The principal apparatus in this system is a vehicle repair frame. The vehicle repair frame can be configured to suit the vehicle repair situation by attaching or mounting various vehicle repair modules on it. The ability to be reconfigured is a unique feature of the present invention in that as the job requirements change, the present invention can be adapted to meet those conditions and requirements. The present invention can become a different tool as required or desired by the operator by simply adding or removing the various separate means for performing a specific operation, which Applicant herein refers to as a module. The several specific modules provide the necessary lifting, support, motive force and means for maneuvering during the vehicle repair procedure. One advantage of the present invention is that the operator may add modules as funds permit or job conditions change. Another advantage to this modular system is that when a module is not in use it can be stored in a convenient manner away from the work area.

In addition to the various frame support modules, lift module and ramp module, the system provides a vehicle restraint module. The vehicle restraint module can be of several different types depending on the needs of the specific repair operation. Different vehicles require different means of restraint during the repair operation, for instance some vehicles can be clamped at their pinch welds while some use a bolt and nut. The various vehicle restraint modules allow the operator to mount and remove the vehicle restraint module from the vehicle repair frame as necessary.

The multi-modular vehicle repair system also provides a force device that apply a force, usually by pulling a chain, to a vehicle during the repair process. However, a force device module of the type that is not attached directly to the vehicle repair frame can also be provided. The present invention provides a straightening tool type of force device module that engages a tool chamber located in the vehicle repair frame. Multiple tool chambers are provided so that an operator can move the force device module to the most advantageous location around the vehicle being repaired.

Other principal features and advantages of the present invention will become apparent to those skilled in the art upon review of the following drawings, the detailed description and the appended claims.

Figure 1:
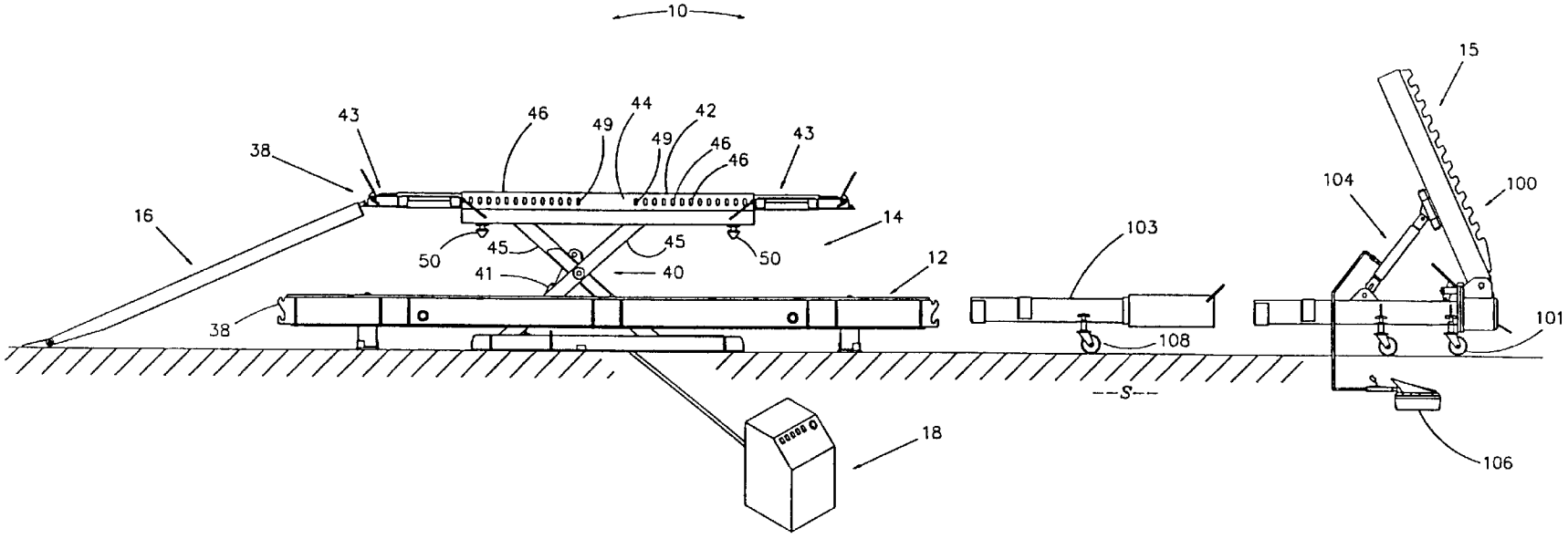
FIG. 1 is a plan view of the multi-modular vehicle repair system with several associated vehicle repair modules.
Figure 2A:
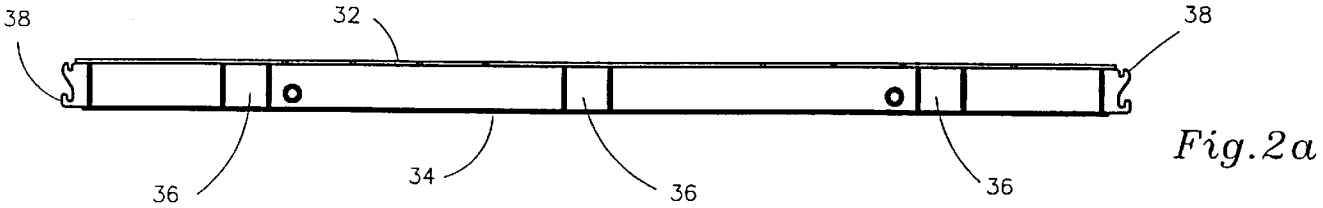
FIG. 2*a* is a side elevation of a vehicle repair frame.
Figure 2C:
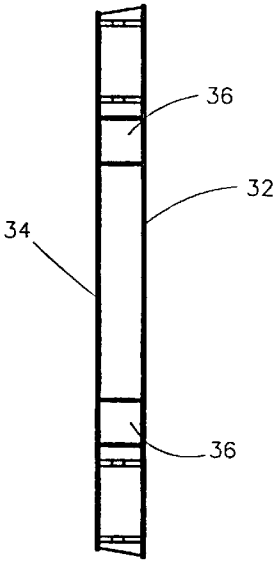
FIG. 2*c* is an end view of a vehicle repair frame.
Figure 2B:
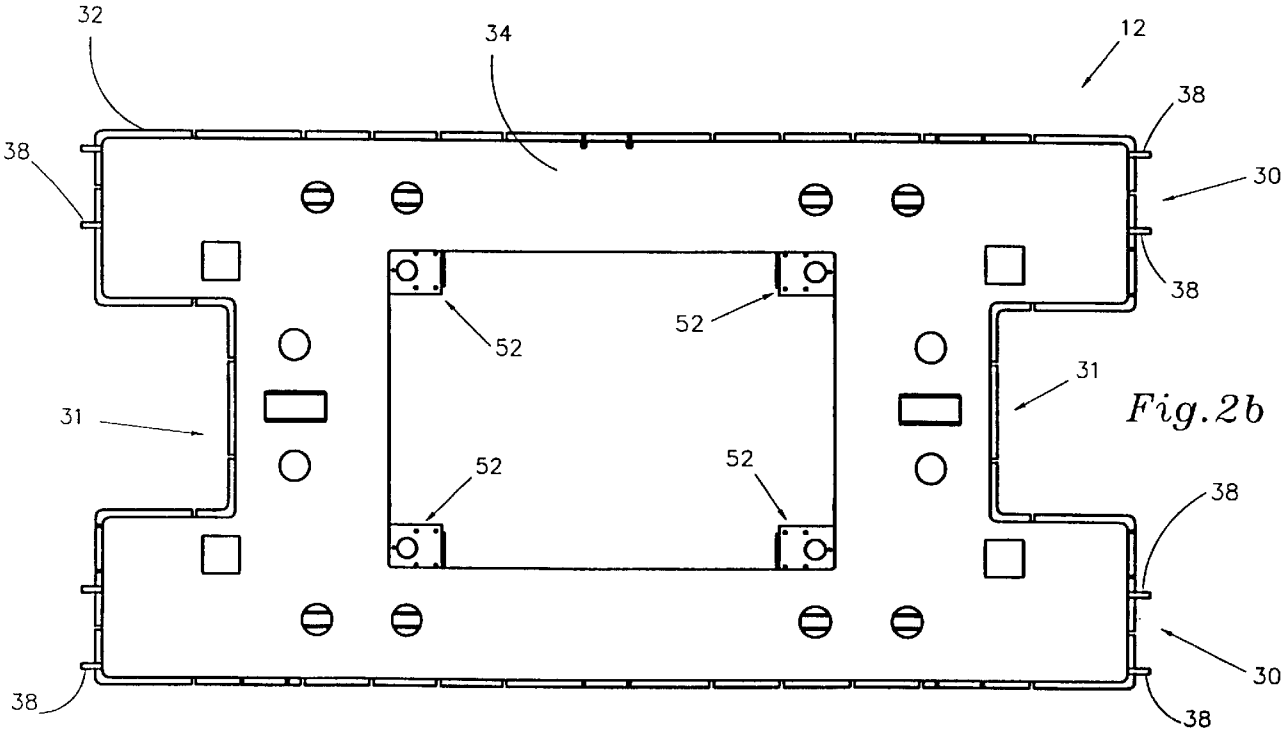
FIG. 2*b* is a bottom view of a vehicle repair frame.
Figure 3A:
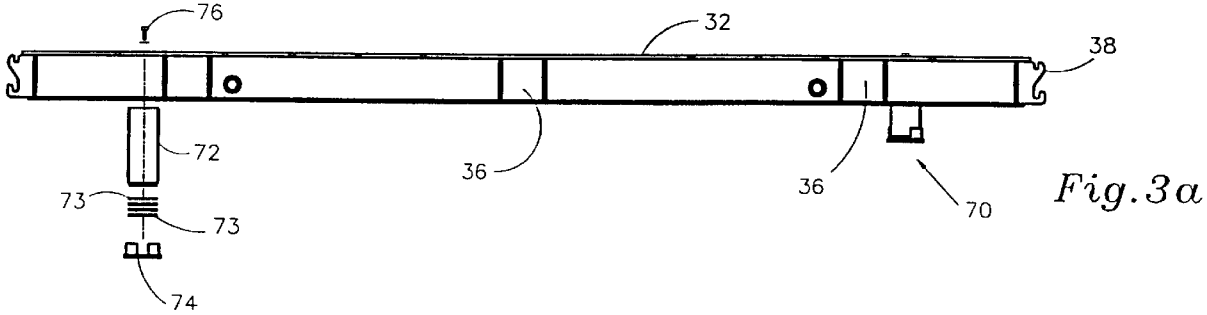
FIG. 3*a* is a side elevation of a vehicle repair frame with two stationary leg sets.
Figure 3B:
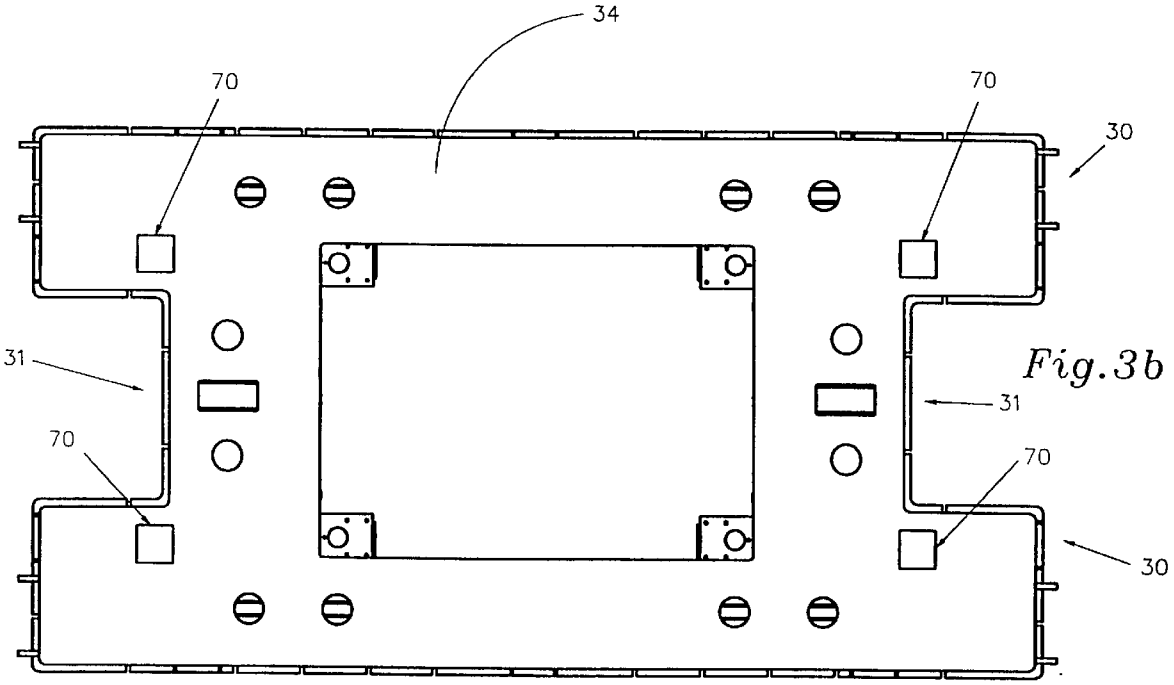
FIG. 3*b* is a bottom elevation of a vehicle repair frame with two stationary leg sets.
Figure 3C:
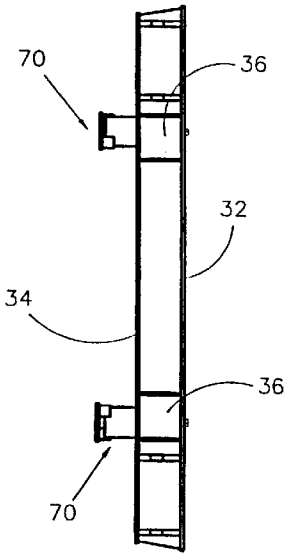
FIG. 3*c* is an end view of a vehicle repair frame with stationary leg sets.

Before explaining the preferred embodiment of the invention in detail it is to be understood that the invention is not limited in its application to the details of construction and the arrangement of the components set forth in the following description or as illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF PREFERRED EMBODIMENT

Figure 10:
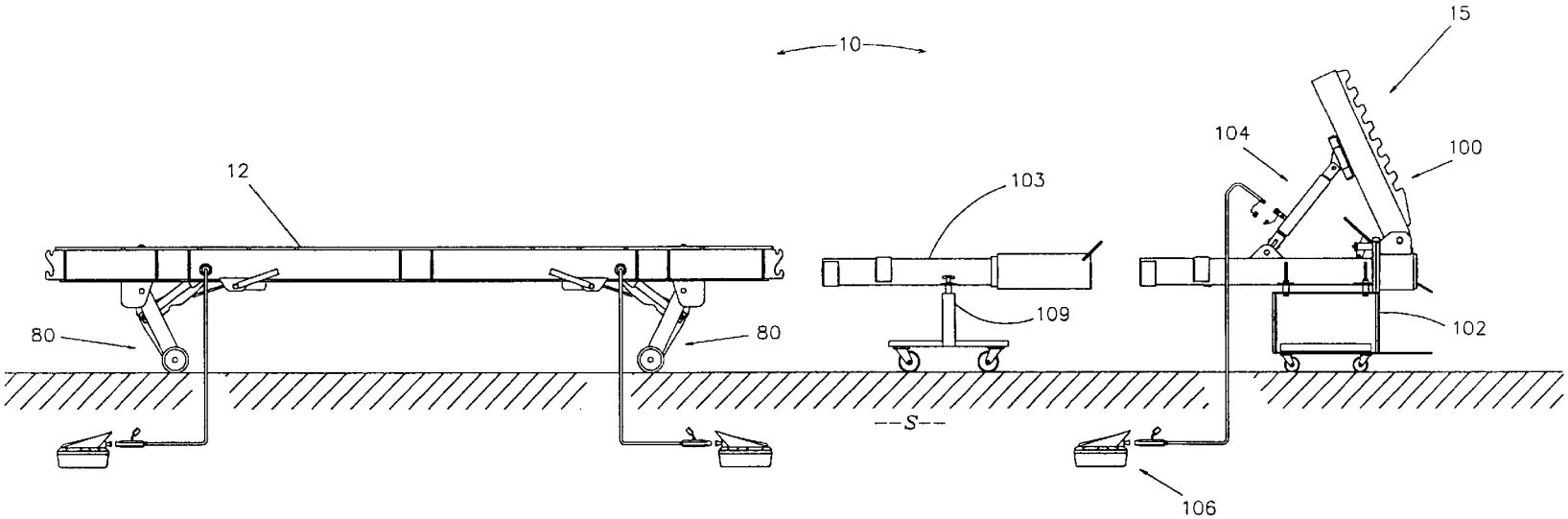
FIG. 10 is a side elevation of a multi-modular vehicle repair system illustrating the vehicle repair frame supported over a surface by a frame support module of the foldable leg set type and associated with a force device with said frame device and its extension being supported by a wheel of the straightening tool type set extensions.

FIGS. 1 and 10 show the multi-module vehicle repair system 10 in two of several configurations. The principal feature of the present invention is that it can be configured in different ways to accommodate various vehicle repair situations. The multi-modular vehicle repair system 10 comprises a vehicle repair frame 12 which can receive a vehicle repair module. Removably mounted on the vehicle repair frame 12 is a vehicle restraint 17 which holds a vehicle in the system during some work procedures. A force device 15 is associated with the vehicle repair frame 12 and can be of several types.

FIGS. 2*a*, 2*b*, 2*c*, 3*a*, 3*b*, 3*c*, 4*a*, 4*b*, 4*c*, 5*a*, 5*b* and 5*c* shows the vehicle repair frame 12 with different frame support modules 13. A frame support module 13 maintains the vehicle repair frame 12 above a work surface during various work procedures of vehicle repair. The vehicle repair frame 12 consists of two parallel, horizontal side frame 30 and two cross members 31, all between a top plate 32 and a bottom plate 34. The vehicle repair frame 12 is provided with a plurality of tool chambers 36 located around the perimeter of the vehicle repair frame 12 at selected locations. The tool chambers 36 are configured to accept the force device 15, which device applies a force to the vehicle during the repair process. The vehicle repair frame 12 is also provided with a plurality of ramp hooks 38 that accept a ramp module 16 as shown in FIG. 1. The ramp module 16 can be set at different locations to facilitate the loading and unloading of a vehicle to the system 10 for the repair work. The vehicle repair frame 12 is also provided with a plurality of locking devices 52. The locking device 52 engages the lift module 14 as will be explained below. The vehicle repair frame 12 can be made of any suitable material such as steel and may be fabricated in parts which can be bolted or welded together.

A vehicle repair module is selected from the group consisting of a frame support module 13, a lift module 14 and a ramp module 16. Usually several such modules are used in conjunction with the vehicle repair frame 12 in the present invention. The ramp module 16 is shown in FIG. 1 and was explained above. The ramp module 16 can be of any suitable length and must be strong enough to support the weight of the vehicle being moved onto or from the system 10. The ramp module can be attached to the vehicle repair frame 12 or to the lift module 14. FIG. 1 shows the ramp module 16 attached to the lift module 14 by ramp hooks 38.

Figures 7A, 7B, 8, 9:
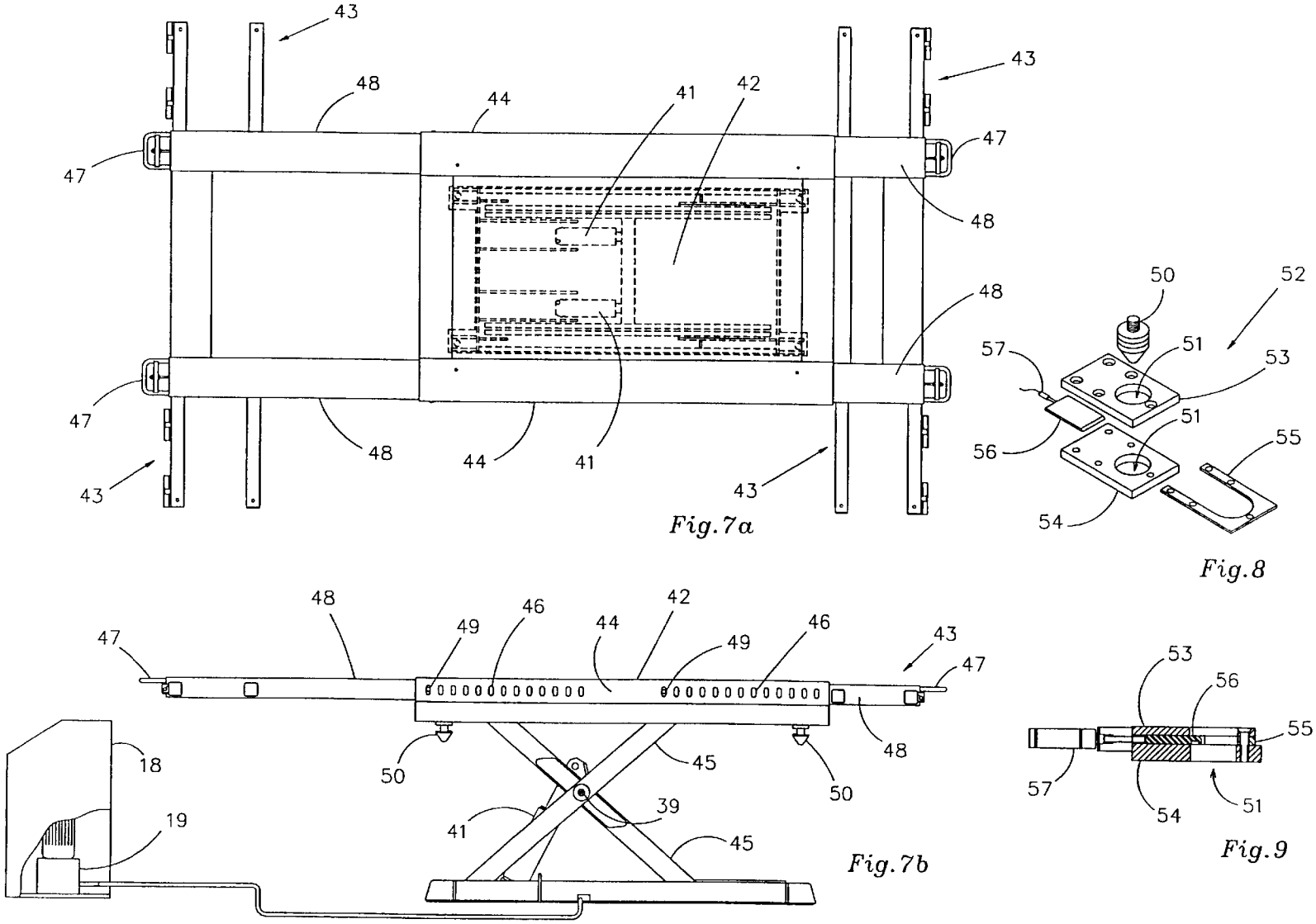
FIG. 7*a* is a top view of a lift module associated with a multi-modular vehicle repair system, said lift module being a scissors lift with one pair of adjustable arms fully extended and one pair of adjustable arms fully retracted.
FIG. 7*b* is a side elevation of a lift module associated with a multi-modular vehicle repair system, said lift module being a scissor lift with one pair of adjustable arms fully extended and one pair of adjustable arms fully retracted.
FIG. 8 is an exploded perspective view of a locking device.
FIG. 9 is a sectional view of a locking device through the longitudinal center plane of such device.

The lift module 14 in the drawings, FIGS. 1, 7*a* and 7*b* is a scissors lift 40. The lift module 14 could also be a hydraulic lift of the single or multiple post type. The preferred embodiment is illustrated in the above cited drawings. The scissors lift 40 consists of a lift platform 42 which is generally a solid plate, on a pair of side frames 44. The side frames are provided with a plurality of holes 46. The lift platform 42 is mounted on a series of lift members 45 configured in a scissor arrangement at a pivot point 39. A suitable fluid accuator 41 is mechanically connected to the lift member 45 and moves the lift platform up or down as determined by the operator controlling a fluid pump 19 at a control panel 18. The fluid pump 19 is in fluid communication with the fluid accuator 41 by any convenient and suitable means. The lift platform 42 is provided with a plurality of adjustable arms 48. Each adjustable arm 40 is reciprocally adjustable and has a lock pin 49 adapted to engage a selected hole 46 in the side frame 44 of the lift platform 42. The lock pin 49 is manipulated by a lock handle 47 which is in mechanical communication with the lock pin 49. One end of each adjustable arm 48 is provided with a wheel support 43. The wheel support 43 supports the vehicle when the vehicle is placed on the system 10. The lift platform 42 is provided with a plurality of locking probes 50, which probes are adapted to engage the locking device 52 mounted on the vehicle repair frame 12. When the locking probe 50 engages the locking device 52, the lift platform 42 and the vehicle repair frame 12 can be raised or lowered as one unit by the lift module 14. The locking device 52 is illustrated in FIGS. 8 and 9. A lock actuator 57 reciprocally moves a lock blade 56 sandwiched between an upper lock plate 53 and a lower lock plate 54 which plates are maintained apart by a spacer 55. The upper lock plate 53, lower lock plate 54 and spacer 55 provide a locking probe hole 51 into which the locking probe 50 is inserted when the lift platform 42 is lowered. The lock blade 56 moves toward the locking probe 50 and catches the backside of the probe 50. The preferred embodiment of the locking probe 50 is frustoconical in shape.

Figures 4A, 4B, 4C:
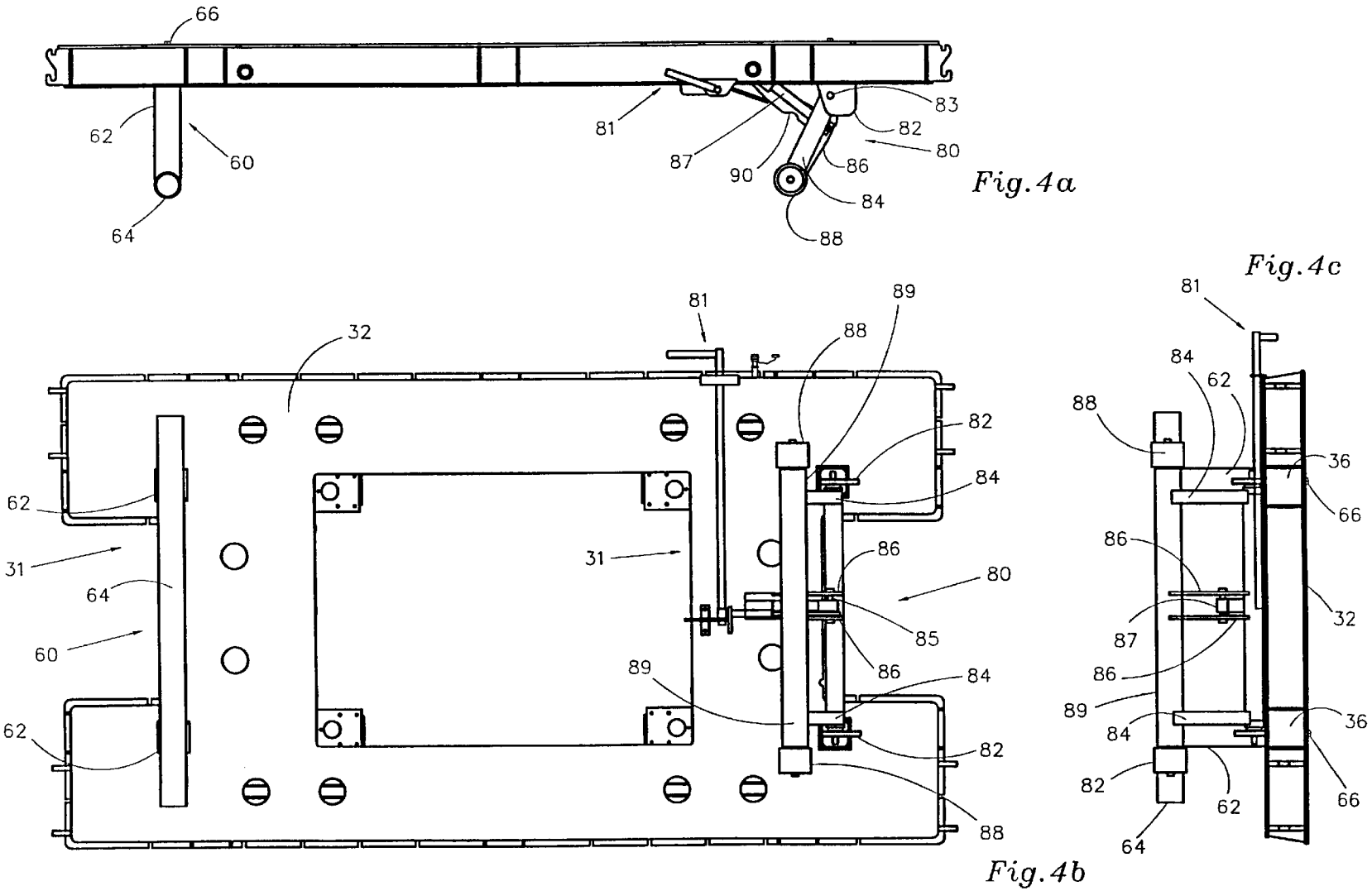
FIG. 4*a* is a side elevation of a vehicle repair frame with one tiltable leg set and one foldable leg set.
FIG. 4*b* is a bottom elevation of a vehicle repair frame with one tiltable leg set and one foldable leg set.
FIG. 4*c* is an end view of a vehicle repair frame with one tiltable leg set and one foldable leg set.
Figure 5A:
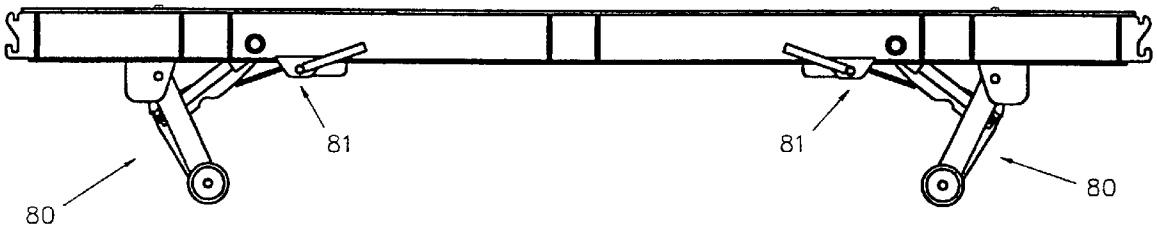
FIG. 5*a* is a side elevation of a vehicle repair frame with two foldable leg sets.
Figure 5C:
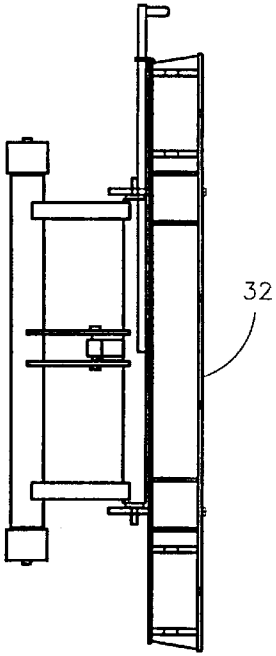
FIG. 5*c* is an end view of a vehicle repair frame with two foldable leg sets.
Figure 5B:
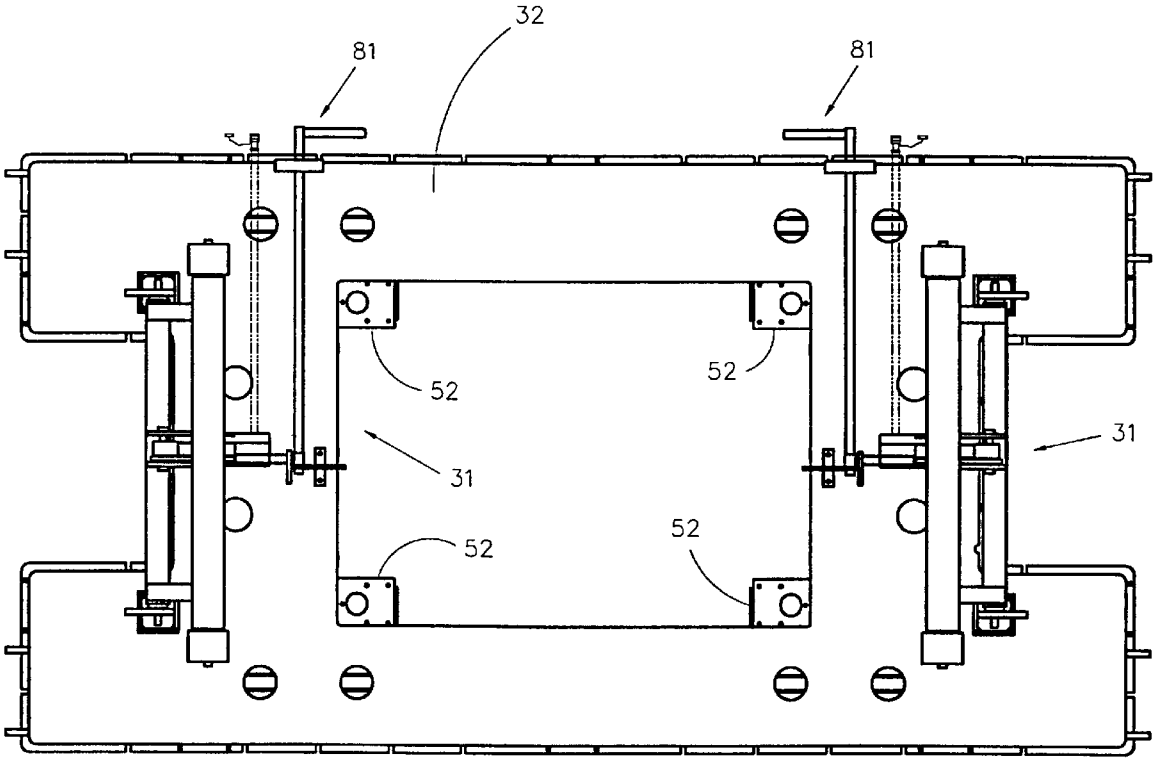
FIG. 5*b* is a bottom elevation of a vehicle repair frame with two foldable leg sets.
Figure 6A:
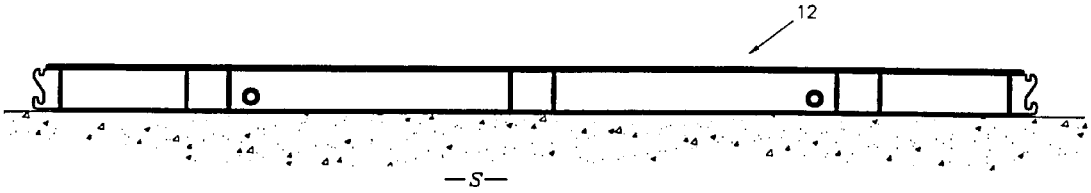
FIG. 6*a* is a side elevation of a vehicle repair frame laying flat on a surface.
Figure 6B:
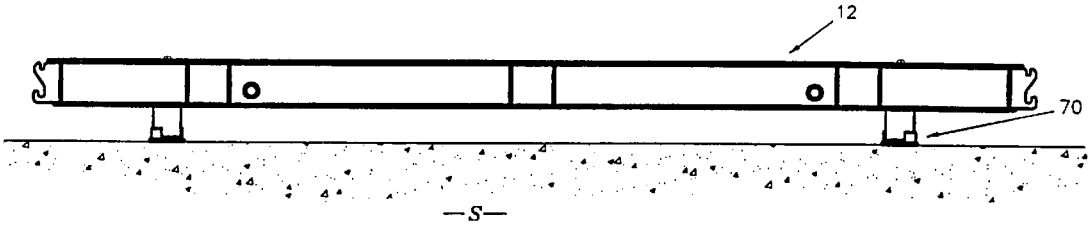
FIG. 6*b* is a side elevation of a vehicle repair frame supported above a surface by stationary leg sets.
Figure 6C:
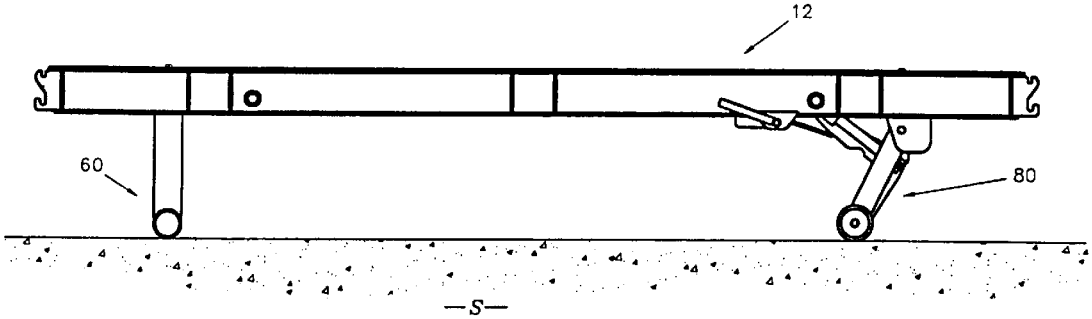
FIG. 6*c* is a side elevation of a vehicle repair frame supported above a surface by one tiltable leg set and one foldable leg set, with said foldable leg set fully extended.
Figure 6D:
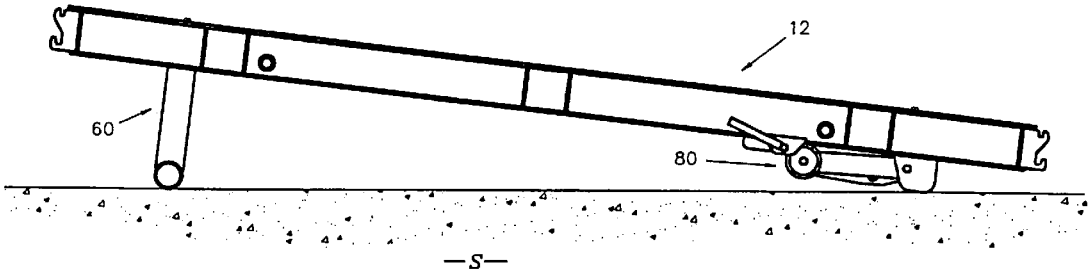
FIG. 6*d* is a side elevation of a vehicle repair frame supported above a surface by one tiltable leg set and one foldable leg set, with said foldable leg set in the folded position.
Figure 6E:
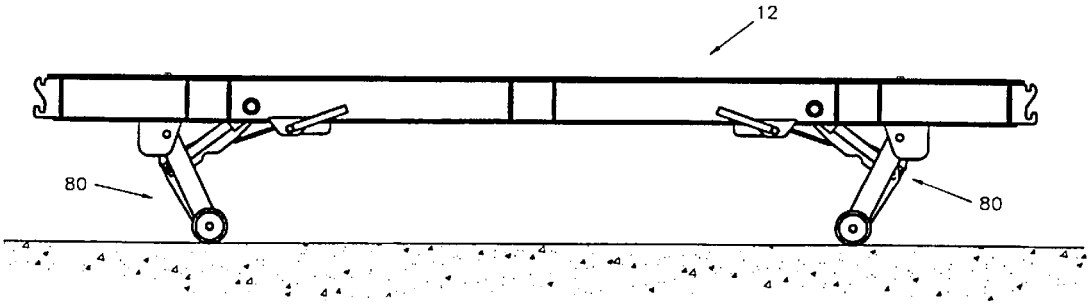
FIG. 6*e* is a side elevation of a vehicle repair frame supported above a surface by two foldable leg sets, with said foldable leg sets fully extended.

The vehicle repair frame 12 may be used by an operator while the vehicle repair frame 12 is directly on a work surface S. The operator would use a ramp module 16 and a force device 15 to perform a repair procedure on the vehicle. The operator can also use a frame support module 13 with the vehicle repair frame 12 such as a tiltable leg set 60, a stationary leg set 70 and a foldable leg set 80. FIGS. 6*a*, 6*b*, 6*c*, 6*d* and 6*e* illustrates several combinations of frame support modules that are possible. The stationary leg set 70 consists of a pair of stationary leg members 72 with each such leg member 72 having a leg pad 74 at one end of the leg member 72 and the other end of the leg member 72 is fastened to the vehicle repair frame 12 by a fastening means 76 such as a bolt, screw or may be welded to the frame. To accommodate variances in the support surface of the repair facility, leg spacers 73 can be used between the leg member 72 and the leg pad 74. FIG. 1 shows the vehicle repair frame 12 using the stationary leg sets 70 in one variant of the multi modular vehicle repair system 10. The tiltable leg set consists of a pair of tiltable leg members 62 with each such leg member being attached at one end to a tilting base 64 and the other end attached to the vehicle repair frame 12 by a fastening means 66 such as a bolt, screw or may be welded to said frame. The tilting base 64 is advantageously rounded in the area that will contact the support surface S to facilitate the tilting motion as shown in FIG. 6*d*. The foldable leg set 80 consists of a pair of foldable leg member 84 each of which is mounted, at one end, on a leg spanner 89. The leg spanner 89 has a roller 88 rotably mounted on each end of the leg spacer 89. The other end of each foldable leg member 84 is pivotally mounted by a pivot 83 to a pivot bracket 82. A pivot bracket 82 is attached to each end of the side frames 30 of the vehicle repair frame 12 as shown in FIGS. 4*b*, 5*a* and 5*b*. The foldable leg set 80 is moved back and forth thereby raising and lowering the end of the vehicle repair frame 12 to which it is attached by means of a fluid cylinder 87 mounted between a cylinder bracket 86 and the leg spanner 89. The foldable leg set is locked in position by a leg lock 81 that engages a lock bar 90. The leg lock 81 is advantageously located so as to be operated without having the operator move underneath the vehicle repair rack 12. The fluid cylinder 87 is operated by a force applicator control 106. FIG. 10 illustrates the vehicle repair frame 12 being supported by two frame support modules 12 of the foldable leg set 80 type. FIG. 6*d* illustrates one foldable leg set 80 in the folded position. In such position the vehicle repair frame 12 is tilted about the tiltable leg set 60 and the frame can now receive or discharge a vehicle.

Figure 12:
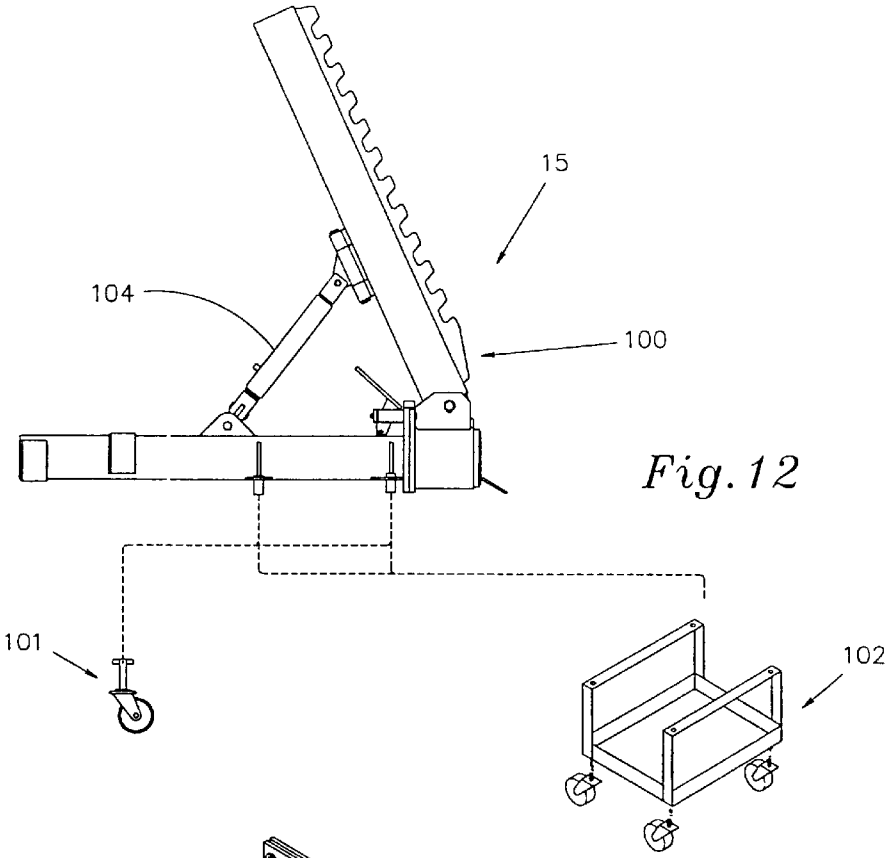
FIG. 12 is a side elevation of a frame device generally referred to as a Dozer® and further illustrating two types of supports for such force device, one being caster wheels and one being a straightening tool wheel set extension.
Figure 14:
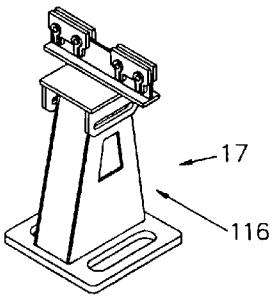
FIG. 14 is a perspective view of second embodiment of a vehicle restraint mountable to a vehicle repair frame of the present invention.
Figure 11:
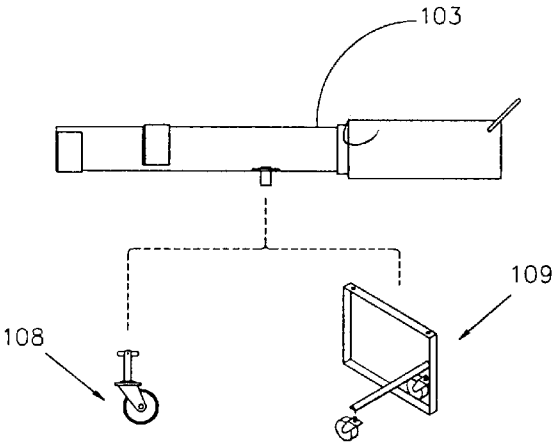
FIG. 11 is a side elevation of a force device extension and illustrating two types of supports for such extension, one being caster wheels and one being a wheel set extension.
Figure 13:
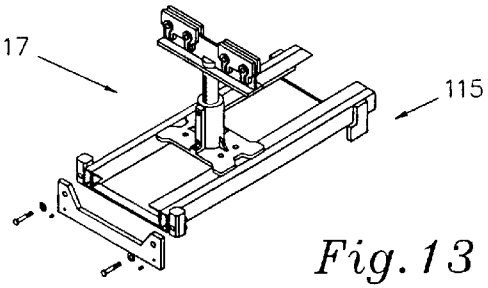
FIG. 13 is a perspective view of one embodiment of a vehicle restraint mountable to a vehicle repair frame of the present invention.

A vehicle is restrained on the vehicle repair frame 12 by a vehicle restraint 17. The vehicle restraint 17 is removably mounted on the vehicle repair frame 12. Two embodiments of a vehicle restraint 17 are illustrated in FIGS. 13 and 14 as items 115 and 116 respectively. The operator of the multi-module vehicle repair system 10 selects the type of vehicle restraint 17 to use and mounts it on the vehicle repair frame 12. The vehicle restraint 17 restricts the movement of the vehicle during the application of force by the force device 15. Typically the force device 15 pulls a chain that is attached to some part of the vehicle being repaired. FIG. 1, 10 and 12 illustrates one type of force device 15. The force device 15 is a straightening tool 100 that has a force applicator 104 such as a fluid cylinder mounted to apply a force to the vehicle being repaired. To facilitate the use of the force device 15 with the vehicle repair frame 12 at the various heights to which the vehicle repair frame 12 can be used, the force device is provided with a straightening tool wheel set 101 and a straightening tool which set extension 102. (See FIGS. 10 and 12). In some applications a force device 15 requires additional length so a straightening tool extension 103 is provided and adapted to mate with the straightening tool 100 by means of a plug and socket. The straightening tool 100 and the straightening tool extension 103 is adapted to mate with one of the tool chambers 36 in the vehicle repair frame 12. Multiple force devices 15 can be used with the vehicle repair frame 12 as required by the particular repair job. The wheel sets 101, 102, 108 and 109 facilitate the maneuvering of the force device 15 about the perimeter of the vehicle repair frame 12.

Thus it should be apparent that there has been provided in accordance with the present invention a multi-modular vehicle repair system comprising a vehicle repair frame adapted to receive a vehicle repair module including a frame support module, a lift module and a ramp module, a vehicle restraint removably mounted on the vehicle repair frame, and a force device, that can be of the push or pull type, associated with the vehicle repair frame that satisfies the objectives and advantages set forth above. Although the invention has been described in conjunction with specific embodiments thereof, it is evident that many alternatives, modifications and variations will be apparent to those ordinarily skilled in the art. Accordingly, it is intended to embrace all such alternatives, modifications and variations that fall within the spirit and scope of the appended claims.

We claim:

1. A multi-modular vehicle repair system that can be configured in different ways to accommodate various vehicle repair situations, said system comprising:

a vehicle repair frame having two parallel, horizontal side frames defining a plurality of tool chambers, a top plate and a bottom plate, with said bottom plate configured to receive a frame support module, said vehicle repair frame further provided with a plurality of locking devices engageable with a lift module, said lift module having a plurality of adjustable arms, with each said arm provided with a vehicle support and which lifting module is positioned between the side frames wherein upon engaging the locking devices the vehicle repair frame and the lift module can be raised and lowered as one unit, a vehicle restraint removably mounted on the vehicle repair frame, a force device associated with the vehicle repair frame, and a ramp module removably mounted on the vehicle repair frame.

2. The multi-modular vehicle repair system of claim 1 including a control panel having controls, hoses, pump and reservoir in communication with the lift module and having pneumatic controls, hose, pump and reservoir in communication with the locking devices.

3. The multi-modular vehicle repair system of claim 1 wherein the force device is a straightening tool removably mounted in the tool chamber.

4. The multi-modular vehicle repair system of claim 1 wherein the frame support module is one selected from a group consisting of a stationary leg set, a tiltable leg set and a folding leg set.

* * * * *